US008070421B2

(12) United States Patent
Dalton et al.

(10) Patent No.: US 8,070,421 B2
(45) Date of Patent: Dec. 6, 2011

(54) MECHANICALLY AFFIXED TURBINE SHROUD PLUG

(75) Inventors: John P. Dalton, Wellington, FL (US); Frank Maichle, Mellingen (CH); Rex A. Smith, Port St. Lucie, FL (US); Matthew Gent, Port St. Lucie, FL (US); Stuart Bishop, Palm City, FL (US); George Obranic, Loxahatchee, FL (US)

(73) Assignee: Siemens Energy, Inc., Orlando, FL (US)

( * ) Notice: Subject to any disclaimer, the term of this patent is extended or adjusted under 35 U.S.C. 154(b) by 924 days.

(21) Appl. No.: 12/055,393

(22) Filed: Mar. 26, 2008

(65) Prior Publication Data

US 2009/0246006 A1 Oct. 1, 2009

(51) Int. Cl.
*F01D 25/08* (2006.01)

(52) U.S. Cl. ..... 415/115; 416/193 A

(58) Field of Classification Search ..... 416/193 A, 416/221

See application file for complete search history.

(56) References Cited

U.S. PATENT DOCUMENTS

| | | | | |
|---|---|---|---|---|
| 3,365,093 | A | 1/1968 | Malenke | |
| 3,635,587 | A * | 1/1972 | Giesman et al. | 416/97 R |
| 3,846,041 | A * | 11/1974 | Albani | 416/97 R |
| 3,982,852 | A | 9/1976 | Andersen et al. | |
| 4,451,959 | A * | 6/1984 | Miller et al. | 416/221 |
| 4,526,512 | A | 7/1985 | Hook | |
| 5,957,657 | A | 9/1999 | Akita et al. | |
| 6,210,106 | B1 | 4/2001 | Hawkins | |
| 6,485,255 | B1 | 11/2002 | Care et al. | |
| 6,554,566 | B1 | 4/2003 | Nigmatulin | |
| 6,679,953 | B1 | 1/2004 | Barnhart et al. | |
| 7,217,081 | B2 | 5/2007 | Scheurlen et al. | |
| 2004/0094287 | A1 | 5/2004 | Wang | |
| 2005/0196277 | A1 | 9/2005 | Wang et al. | |

* cited by examiner

*Primary Examiner* — Richard Edgar

(57) ABSTRACT

A sealing interface for a component in a turbine machine, wherein a plug is mechanically affixed within an entrance passage of an aperture. The plug is secured in place within the entrance passage through deformation of an inner end of the plug to cause the plug to mechanically engage a groove formed adjacent the entrance passage.

20 Claims, 2 Drawing Sheets

MECHANICALLY AFFIXED TURBINE SHROUD PLUG

FIELD OF THE INVENTION

The present invention relates generally to a plug for use in a turbine engine, and more particularly, to a plug which is mechanically affixed in a shroud crossfeed aperture.

BACKGROUND OF THE INVENTION

In multistage rotary machines used for energy conversion, a fluid is used to produce rotational motion. In a gas turbine engine, for example, a gas is compressed in a compressor and mixed with a fuel source in a combustor. The combination of gas and fuel is then ignited for generating combustion gases that are expanded through a turbine to produce rotational motion. Both the turbine stage(s) and the compressor have stationary or non-rotary components, such as vanes, for example, that cooperate with rotatable components, such as rotor blades, for example, for compressing and expanding the operational gases.

As temperatures within the machines become substantially high, it is important to cool components of the machine to prevent overheating that could lead to decreased performance, inefficiency, and/or failure, including melting. During development of the machines, cooling air passages are formed through shrouds that are affixed to the vanes and/or rotor blades. The air passages are used to transfer cooling air to areas of the vanes and/or rotor blades which are to be cooled. Typically, when these cooling air passages are formed in the shrouds, a crossfeed aperture may be formed in an end portion of the shroud. These apertures are subsequently sealed to prevent an escape of the cooling air.

A known prior art technique for sealing these apertures by welding or brazing procedures can be time consuming. Such welding and brazing procedures can result in excess welding or brazing material being deposited in the cooling air passages. Once in the cooling air passages, this material can harden and subsequently limit cooling air flow causing inadequate cooling of the parts. Further, applying welding or brazing material to close off the apertures can adversely affect shroud machining operations, such as seal slot electrical discharge machining, in that the welding or brazing material may be harder and consequently less conducive to further machining operations.

In view of the foregoing considerations it would be desirable to provide a plug for use in a shroud of a rotary machine, whereby the plug can be mechanically affixed in shroud crossfeed apertures, and wherein the plug permits performance of follow-up shroud machining operations.

SUMMARY OF THE INVENTION

In accordance with a first aspect of the present invention, a sealing interface is provided for a component in a turbine machine having cooled components. The component includes a bore extending into the component from an outer side wall thereof. The sealing interface comprises an entrance passage defining an outer end of the bore adjacent the outer side wall of the component, a shoulder surface defined at an end of the entrance passage distal from the outer side wall, and a plug located within the entrance passage. The plug includes a mechanical clamping portion adjacent the shoulder surface for mechanically retaining the plug within the entrance passage.

In accordance with a second aspect of the present invention, a sealing interface is provided for a component in a turbine machine having cooled components. The component includes a bore extending into the component from an outer side wall thereof. The sealing interface comprises an entrance passage defining an outer end of the bore adjacent the outer side wall of the component. The entrance passage defines a first diameter of the bore. A fluid passage defines an inner portion of the bore defining a second diameter of the bore. A shoulder surface is defined at an end of the entrance passage distal from the outer side wall and extending radially between the entrance passage and the fluid passage. A plug is located within the entrance passage and includes a mechanical clamping portion adjacent the shoulder surface for mechanically retaining the plug within the entrance passage.

In accordance with a third aspect of the present invention, a method is provided for sealing a bore formed in an outer side wall of a component of a turbine machine having cooled components. The method comprises the steps of inserting a plug into an entrance passage of the bore, causing the plug to contact a shoulder surface defined at an end of the entrance passage distal from the outer wall, and mechanically deforming the plug against the shoulder surface to mechanically retain the plug within the entrance passage.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
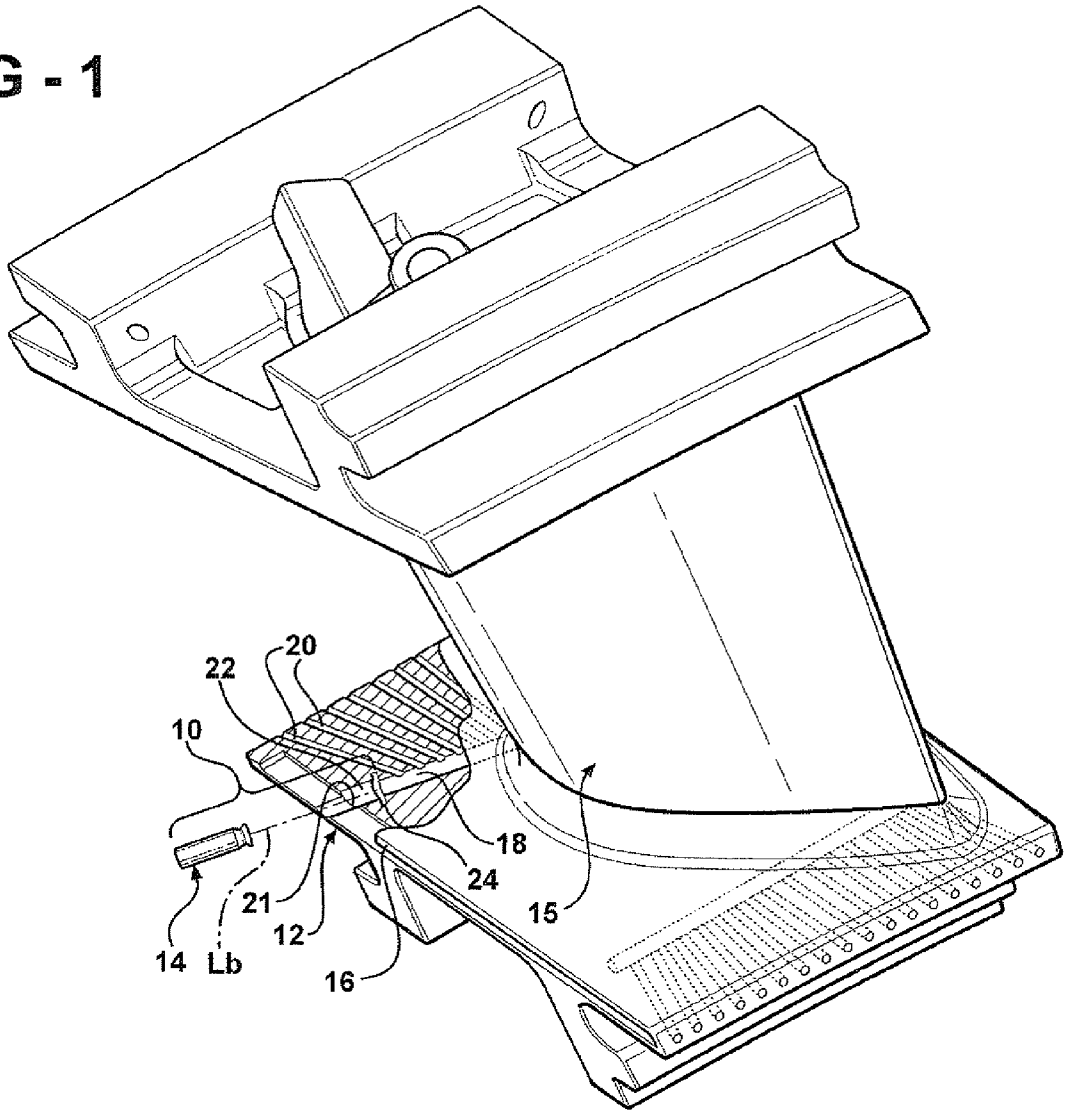
FIG. 1 is an exploded perspective partial cutaway view of a component and a plug which form a sealing interface in accordance with an embodiment of the invention.

According to aspects of the present invention, a sealing interface 10 implemented in a gas turbine engine (not shown) having cooled components is shown in FIGS. 1-4. The sealing interface 10 is formed by a component 12 and a plug 14, as shown in FIG. 1. In the embodiment shown, the component 12 is a non-rotating vane shroud mounted to a non-rotating vane assembly 15, although the sealing interface 10 described herein may be incorporated in other types of components including, without limitation, a shroud for a rotating turbine blade.

Figure 2:
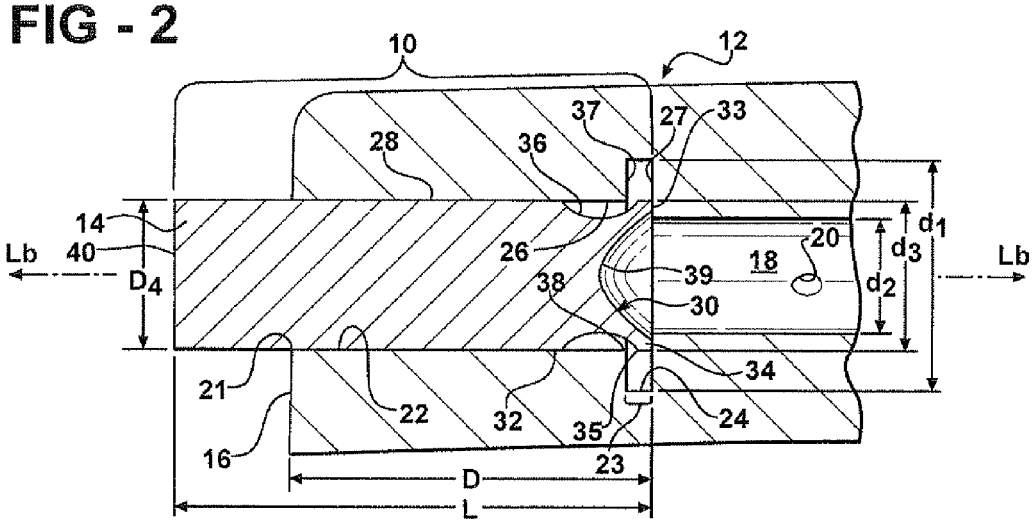
FIG. 2 is a side cross sectional view of the sealing interface illustrated in FIG. 1 showing the plug in a partially inserted position.

As seen in FIGS. 1 and 2, the component 12 includes a generally flat outer side wall 16. A bore 18 having a longitudinal axis Lb is formed in the component 12, extending inwardly from the side wall 16. The bore 18 is in fluid communication with cooling fluid passages 20 which are also formed in the component 12. While a plurality of cooling fluid passages 20 are shown, it is understood that additional or fewer cooling fluid passages can be formed in the component 12 and in fluid communication with the bore 18 without departing from the scope and spirit of the invention.

An outer end 21 of the bore 18 defines an entrance passage 22 of generally circular cross-section and having a substantially constant diameter. It is understood that the entrance passage 22 can have other suitable shapes as desired. An undercut portion 23 defined by undercut groove 24 is formed in the component 12 at an inner end 26 of the entrance passage 22. A diameter d1 of the undercut groove 24 is larger than a diameter d2 bore 18, and is larger than a diameter d3 of the entrance passage 22. Further, the diameter d2 of the bore 18 is smaller than the diameter d3 of the entrance passage 22. A shoulder surface 27 is formed at the inner end 26 of the entrance passage 22 extending radially between the undercut groove 24 and the bore 18 and extending substantially perpendicular to the longitudinal axis Lb of the bore 18. The shoulder surface 27 defines a transition from the diameter d3 of the entrance passage 22 to the diameter d2 of the bore 18.

In the embodiment described, the plug 14 is formed from an INCONEL alloy (INCONEL is a registered trademark of Special Metals Corporation), although any suitable malleable material may be used to form the plug 14 as desired. In the embodiment shown, a length L of the plug 14 is at least as long as a depth D of the entrance passage 22 of the component 12, although the plug 14 may have any suitable length. The plug 14 includes a cylindrical, elongate main body 28 having a substantially constant diameter d4. In a preferred embodiment, the diameter d4 of the main body 28 is slightly smaller than the diameter d3 of the entrance passage 22. A relatively close fit between the main body 28 and the entrance passage 22 facilitates insertion through the entrance passage 22 and additionally ensures alignment of the plug 14 within the entrance passage 22.

Figure 3:
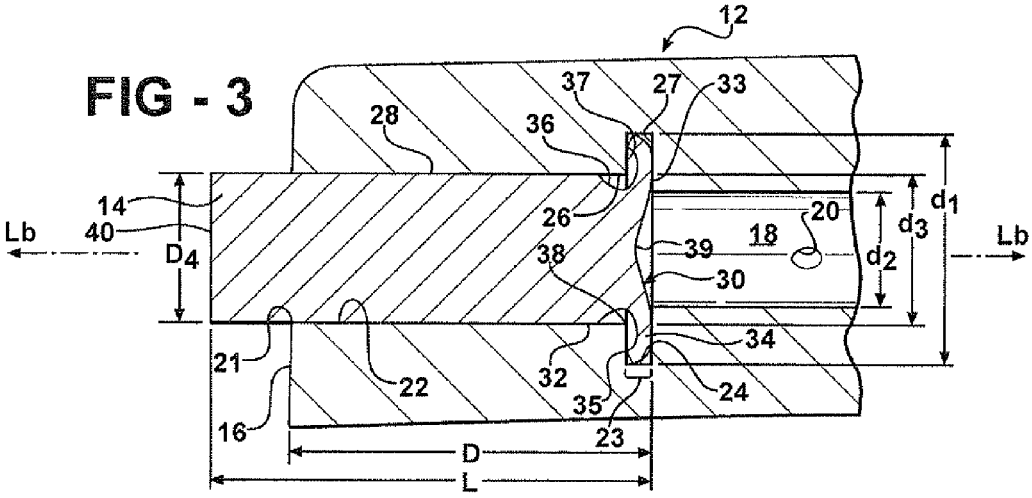
FIG. 3 is a side cross sectional view of the sealing interface showing the plug in a fully inserted position.

Referring to FIGS. 2 and 3, a mechanical clamping portion 30 is formed at an inner end 32 of the main body 28. The mechanical clamping portion 30 includes a radially extending flange 34. The flange 34 is adapted to engage the undercut groove 24 of the component 12. A first surface 33 of the flange 34 is adapted to engage the shoulder surface 27. The engagement of the first surface 33 to the shoulder surface 27 may create a substantially fluid tight seal therebetween. A second surface 35 of the flange 34 is adapted to engage an annular outer surface 37 of the undercut groove 24. The mechanical clamping portion 30 has an annular area of reduced diameter 36 formed between the flange 34 and the main body 28. The area of reduced diameter 36 forms a substantially smooth concave transition from the main body 28 to the flange 34. The area of reduced diameter 36 is adapted to provide clearance from an edge 38 between the entrance passage 22 and the undercut groove 24 when the plug 14 is installed in the bore 18. The mechanical clamping portion 30 also includes a curved surface 39 having a concave side facing the cooling fluid passage 20.

A process of forming the sealing interface 10 will now be described. At least one cooling fluid passage 20 is formed in the component 12, such as by an electro-discharge procedure, drilling, or other process known in the art. The bore 18 is then formed in the component 12 in fluid communication with the cooling fluid passages 20, such as by an electro-discharge procedure, drilling, or other process known in the art. Once the bore 18 is formed in the component 12, the entrance passage 22 and the undercut groove 24 may be formed in the component 12 by any known process. For example, an orbital electro-discharge procedure, although other means for forming the undercut groove 24 may be used. The formation of the entrance passage 22 and the undercut groove 24 also forms the shoulder surface 27 and the edge 38 between the entrance passage 22 and the undercut groove 24.

The plug 14 is separately formed to desired specifications. Once formed, the plug 14 is aligned with the bore 18 to a position, as shown in FIG. 1. The plug 14 is then inserted into the entrance passage 22 to a position, as shown in FIG. 2, by applying an insertion force to the main body 28 of the plug 14 in the direction of the inner end 26 of the of the entrance passage 22. The force can be applied as a pushing force or a striking force, for example. Once the flange 34 of the plug 14 reaches the shoulder surface 27, continued insertion force against the main body 28 of the plug 14 into the entrance passage 22 causes the flange 34 to engage the undercut groove 24 and deform into the shape shown in FIG. 3. The area of reduced diameter 36 and the curved surface 39 create a thin wall area to promote a predictable deformation of the plug 14. Specifically, the area of reduced diameter 36 and the curved surface 39 cause the flange 34 to deform radially outwardly and also axially back toward the main body 28 of the plug 14. In the embodiment shown, the flange 34 does not completely fill the area defined by the undercut groove 24. However, it is understood that the flange 34 could be designed to fill more or less of the area defined by the undercut groove 24, or could be designed to fill the entire area defined by the undercut groove 24, without departing from the scope and spirit of the invention.

Optionally, a feature may be provided on the plug 14 for identifying or controlling the depth of insertion into the bore 18. For example, an engraved or raised feature (not shown) may be formed on the plug 14 which may become flush with the side wall 16 when fully inserted into the bore 18. Alternatively, the plug 14 may have at least a partially tapered diameter to assist in properly inserting the plug 14 to a correct depth within the bore 18. In this case, the outer surface of the plug 14 could be designed to contact the side wall 16 to prevent further insertion into the bore 18 once the plug 14 is inserted to the correct depth.

Deformation of the flange 34 within the undercut groove 24 to affix the plug 14 within the entrance passage 22 prevents withdrawal of the plug 14 from the entrance passage 22. This affixation is performed without the need for additional procedures, such as welding or brazing. Further, the contact between the first surface 33 of the flange 34 and the shoulder surface 27 may be provided to create a substantially fluid tight seal between the component 12 and the plug 14. It should be understood that a substantially fluid tight seal could additionally or alternatively be created by engagement of the main body 28 of the plug 14 with the surrounding wall of the entrance passage 22. In this case, a plug having a tapered diameter as described above could assist in creating the substantially fluid tight seal by contacting the surrounding wall of the entrance passage 22. Alternatively, an outer end 40 of the plug 14 could be expanded, such as by striking the outer end 40 with a punch (not shown), for example. In this case, any excess length of the plug 14 extending outwardly beyond the outer side wall 16 would be removed and the punch would then expand the second end 40 of the plug 14 to fill the surrounding area of the entrance passage 22 to eliminate clearance between the plug 14 and the entrance passage 22. Additionally, contact between the second surface 35 of the flange 34 and the annular outer surface 37 of the undercut groove 24 may be provided to limit axial movement between the plug 14 and the component 12 and/or to provide additionally sealing surfaces.

Figure 4:
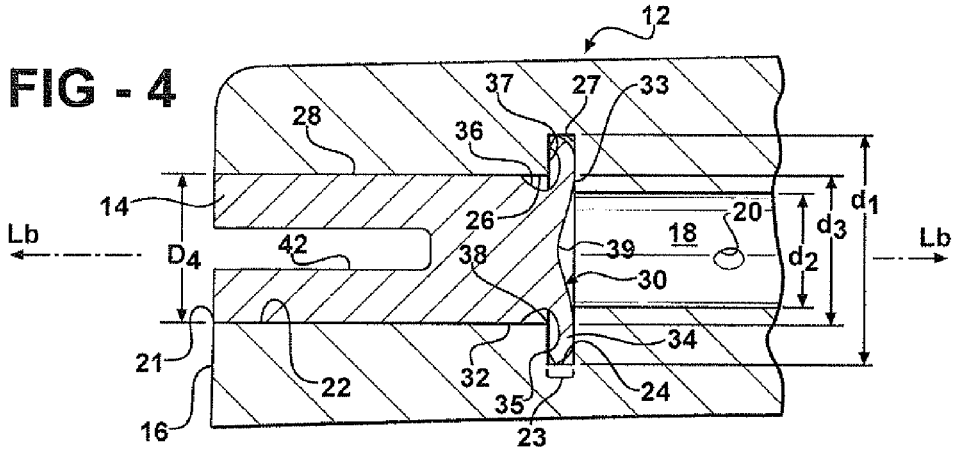
FIG. 4 is a side cross sectional view of the sealing interface after follow-up machining operations have been performed.

Moreover, the malleable material used to form the plug 14 permits the application of follow-up machining operations. In particular, by affixing the plug 14 within the entrance passage 22 in such a manner that substantially only malleable material is present adjacent the outer side wall 16, i.e., without additional relatively hard material typically associated with brazing and/or welding, the outer end 40 of the plug 14 may be machined or shaped. For example, various machining or shaping operations may be performed on the outer end 40 of the plug 14 including, without limitation, surface grinding to provide a desired finish of the component/plug structure, or electrical discharge machining to form an axial slot 42 in the component/plug structure, as shown in FIG. 4. The slot 42 may be adapted, for example, to receive an elongate fastener (not shown) that is used to affix adjacent components (not shown) to the component 12, as is known in the art.

It should be noted that although the present embodiment of the invention is described with reference to forming a substantially fluid tight seal, the sealing interface 10 may be utilized to provide a closure to an opening in which the engagement of the flange 34 within the groove 24 may or may not completely seal the bore 18 at the entrance passage 22, e.g., to provide a restriction to passage of fluid.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A sealing interface for a component in a turbine machine having cooled components, said component including a bore extending into said component from an outer side wall thereof, said sealing interface comprising:

an entrance passage defining an outer end of said bore adjacent said outer side wall of said component;

a shoulder surface defined by a surface of said component at an end of said entrance passage distal from said outer side wall;

an undercut portion within said entrance passage adjacent said shoulder surface, said undercut portion comprising an annular groove; and a plug located within said entrance passage and including a mechanical clamping portion comprising an inner end portion of said plug including an outwardly extending flange deformed within said undercut portion for mechanically retaining said plug within said entrance passage, said plug engaged with said shoulder surface to create a substantially fluid tight seal between said plug and said shoulder surface so as to restrict a passage of fluid out of said entrance passage.

2. The sealing interface of claim 1, wherein said plug is formed of a malleable material and said flange is formed integrally with a body portion of said plug.

3. The sealing interface of claim 1, wherein said inner end portion of said plug comprises a concave surface facing in a direction toward said shoulder surface.

4. The sealing interface of claim 1, wherein said bore includes a fluid passage having diameter that is less than a diameter of said entrance passage, and said shoulder surface defines a transition from the diameter of said entrance passage to the diameter of said fluid passage.

5. The sealing interface of claim 4, wherein said shoulder surface extends substantially perpendicular to a longitudinal axis of said bore.

6. The sealing interface of claim 4, wherein said undercut groove defines a diameter that is greater than the diameter of a remaining portion of said entrance passage.

7. A sealing interface for a component in a turbine machine having cooled components, said component including a bore extending into said component from an outer side wall thereof, said sealing interface comprising:

an entrance passage defining an outer end of said bore adjacent said outer side wall of said component, said entrance passage defining a first diameter of said bore;

a fluid passage defining an inner portion of said bore and comprising a second diameter of said bore;

a shoulder surface defined at an end of said entrance passage distal from said outer side wall and extending between said entrance passage and said fluid passage; and a plug located within said entrance passage and including a mechanical clamping portion engaged with said shoulder surface for mechanically retaining said plug within said entrance passage to create a substantially fluid tight seal between said plug and said shoulder surface so as to restrict a passage of fluid out of said entrance passage.

8. The sealing interface of claim 7, including an undercut portion adjacent said shoulder surface, and said mechanical clamping portion comprises an inner end portion of said plug engaged within said undercut portion.

9. The sealing interface of claim 8, wherein said undercut portion comprises an undercut groove.

10. The sealing interface of claim 9, wherein said inner end portion of said plug comprises a radially extending flange deformed into said undercut groove and said inner end portion of said plug comprises a concave surface facing in direction toward said shoulder surface.

11. The sealing interface of claim 10, wherein said undercut groove defines a diameter that is greater than the diameter of said entrance passage.

12. The sealing interface of claim 11, wherein the diameter of said fluid passage is less than the diameter of said entrance passage.

13. A method for sealing a bore formed in a component of a turbine machine having cooled components, said bore extending into said component from an outer side wall thereof, comprising the steps of:

inserting a plug into an entrance passage of said bore, said plug including a mechanical clamping portion for mechanically retaining said plug within said entrance passage, said entrance passage defining an outer end of said bore;

causing said plug to contact a shoulder surface defined at an end of said entrance passage distal from said outer side wall by applying a pushing or striking force to said plug in a direction from said outer side wall to the end of said entrance passage; and mechanically deforming said plug against said shoulder surface to mechanically retain said plug within said entrance passage to create a substantially fluid tight seal between said plug and said shoulder surface so as to restrict a passage of fluid out of said entrance passage.

14. The method of claim 13, further comprising the step of grinding a portion of said plug adjacent to said outer side wall.

15. The method of claim 14, further comprising the step of forming an axial slot in said outer side wall of said component and said plug, said slot adapted to receive an elongate fastener member therein for fastening an adjacent second component to said component.

16. The method of claim 15, wherein said slot is formed in said outer side wall of said component and said plug by a process of electrical discharge machining.

17. The method of claim 13, wherein said entrance passage includes an annular undercut portion adjacent said shoulder surface, and said step of deforming said plug comprises deforming an end portion of said plug outwardly into said undercut portion.

18. The method of claim 17, wherein said mechanical clamping portion comprises an outwardly extending flange that is deformed outwardly into said undercut portion.

19. The method of claim 18, wherein said plug is formed from a malleable material, and wherein mechanically deforming said plug against said shoulder surface comprises continuing to apply a pushing or striking force to said plug in the direction from said outer side wall to the end of said entrance passage so as to cause the flange to deform radially outwardly into said undercut portion.

20. The method of claim 13, wherein said shoulder surface is defined by a surface of said component.

* * * * *